US008066358B2

(12) United States Patent
Ogle et al.

(10) Patent No.: US 8,066,358 B2
(45) Date of Patent: Nov. 29, 2011

(54) OVER-MOLDED FLUID INTERCONNECT

(75) Inventors: Holli C. Ogle, Corvallis, OR (US); Ralph L. Stathem, Corvallis, OR (US); Steven Lunceford, Corvallis, OR (US); Garry P. Liddell, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1038 days.

(21) Appl. No.: 11/699,937

(22) Filed: Jan. 30, 2007

(65) Prior Publication Data

US 2008/0180493 A1 Jul. 31, 2008

(51) Int. Cl.
*B41J 2/175* (2006.01)

(52) U.S. Cl. ..... 347/85; 347/84; 347/86

(58) Field of Classification Search ..... 347/86, 347/85, 84

See application file for complete search history.

(56) References Cited

U.S. PATENT DOCUMENTS 6,422,693 B2 7/2002 Pawlowski, Jr. et al.
6,644,796 B2 11/2003 Olsen
6,648,458 B2 11/2003 Dod et al.
6,692,118 B2 * 2/2004 Michele et al. ..... 347/86
6,702,434 B2 3/2004 Barinaga et al.
6,739,709 B2 * 5/2004 Nip ..... 347/86
6,824,139 B2 11/2004 Barinaga et al.
6,916,088 B2 7/2005 Smith et al.
6,948,801 B2 9/2005 Rehman et al.
6,964,473 B2 11/2005 Martin
7,025,448 B2 4/2006 Olsen
2002/0122104 A1 * 9/2002 Hatasa et al. ..... 347/86
2002/0149646 A1 * 10/2002 Pawlowski et al. ..... 347/50
2004/0001127 A1 * 1/2004 Nip ..... 347/86
2006/0017790 A1 * 1/2006 Jin ..... 347/86

OTHER PUBLICATIONS

International Search Report for Application PCT/US2008/051265. Report issued Apr. 29, 2008.

* cited by examiner

*Primary Examiner* — Laura Martin

(57) ABSTRACT

A fluid interconnect for a fluid enclosure includes an over-molded sealing surface of a thermoplastic elastomeric material, the sealing surface having an opening, the sealing surface overmolded upon a thermoplastic surface of a fluid enclosure; and a wall of the thermoplastic elastomeric material connected to the sealing surface, the wall enclosing a pathway, the pathway communicating with the opening at a first end; and a layer connected to the wall, the layer closing the pathway at a second end.

19 Claims, 4 Drawing Sheets

OVER-MOLDED FLUID INTERCONNECT

BACKGROUND

Inkjet-printing devices, such as inkjet printers, operate by ejecting ink onto media to form images on the media. For instance, a printhead may be moved back and forth across the media, and the media advanced perpendicular to the movement of the printhead across the media. While the inkjet printhead moves across the media, it ejects ink onto the media to form an image.

At least in some types of inkjet-printing devices, traditionally the inkjet printhead and the ink have been encased in an enclosure known as an inkjet cartridge. In some designs, the ink of the cartridge is depleted before the inkjet printhead requires replacement. Thus, when the ink runs out, a new cartridge has to be inserted into the printer. In some designs, the inkjet printhead has been separated from the ink supply as separately replaceable consumable items. An inkjet printhead may be inserted into an inkjet-printing device, and then just a supply of ink may be mated with the printhead already installed within the printing device, or before the printhead is installed.

Where the ink is encased in a supply separate from the inkjet printhead, the mating process between the printhead and the supply should ensure that there are no resulting fluid leaks. Furthermore, a supply may be later removed from the printhead before the ink therein is depleted. When the supply is so removed, as well as before the supply is first mated with the printhead, there should be no fluid leaks.

SUMMARY OF THE INVENTION

A fluid interconnect for a fluid enclosure is disclosed herein. The fluid interconnect comprises an overmolded sealing surface of a thermoplastic elastomeric material. The sealing surface has an opening and is overmolded upon a thermoplastic surface of a fluid enclosure. A wall of the elastomeric material is connected to the overmolded sealing surface. The wall encloses a pathway and communicates with the opening at a first end. The fluid interconnect also has a layer connected to the wall closing the pathway at a second end of the pathway.

BRIEF DESCRIPTION OF THE DRAWINGS

The drawings referenced herein form a part of the specification. Features shown in the drawings are meant as illustrative of exemplary embodiments of the invention.

DETAILED DESCRIPTION OF THE DRAWINGS

Figure 1A:
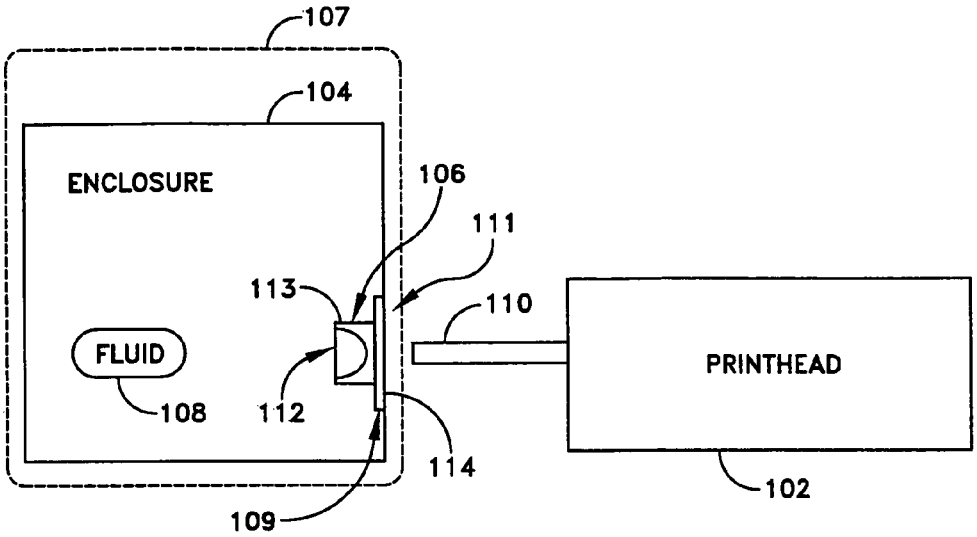
FIGS. 1A, 1B, 1C, and 1D are diagrams showing a fluid interconnect over-molded on an enclosure of fluid, and a printhead being inserted into and removed from the enclosure through the fluid interconnect according to an exemplary embodiment of the invention.

In the following detailed description of exemplary embodiments of the invention, reference is made to the accompanying drawings that form a part hereof, and in which is shown by way of illustration exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined by the appended claims.

FIGS. 1A, 1B, 1C and 1D show a printhead 102 being inserted into and removed from an enclosure 104 of fluid 108 through a fluid interconnect 106, according to an exemplary embodiment of the invention. The printhead 102 has a needle 110 or mating member that is able to pierce the fluid interconnect 106 to access the fluid 108 encased within the enclosure 104. An exemplary embodiment of the needle 110 may be an injection molded thermoplastic needle. Another exemplary embodiment of the needle 110 may be a metallic needle. Another exemplary embodiment of the needle 110 may be a metallic needle. The printhead 102 is more generally an external mating member, in that it is a member that mates with the fluid interconnect 106, and that is external to the fluid interconnect 106. The printhead 102 may be part of an inkjet-printing device, such as an inkjet printer, where corresponding instances of the enclosure 104 for each different color of ink used in the device may be used for forming images on media.

The fluid 108 encased within the enclosure 104 may be ink in one embodiment. The enclosure 104 may be considered an ink supply, or a part of the ink supply, in one embodiment. For instance, the dotted line 107 surrounding the enclosure 104 and the fluid interconnect 106 in FIG. 1A in particular is indicative of an ink supply in one embodiment, which may include the enclosure 104, the fluid interconnect 106, and potentially the fluid 108.

In general, the fluid interconnect 106 is over-molded upon a surface 109 enclosing an opening 114 in a wall 200 of the enclosure 104 and adhering to the enclosure 104. The fluid interconnect 106 is a thermoplastic elastomeric material 350, whereas the enclosure may be an injection molded thermoplastic. The thermoplastic and the thermoplastic elastomer may have similar molecular structure or families to provide for physical entanglement that creates the above mentioned adhesion. This physical entanglement acts as a locking mechanism on a molecular level to ensure that the fluid 108 cannot leak or escape from the enclosure 104 at the junction of the enclosure 104 and the fluid interconnect 106. In an exemplary embodiment, the thermoplastic may be polypropylene and the thermoplastic elastomer may be thermoplastic rubber under the name SANTOPRENE or a blend of polypropylene and ethylene propylene diene monomer (EPDM). In another exemplary embodiment, the thermoplastic may be styrene based (such as acrylonitrile butadiene styrene (ABS) or high impact polystyrene (HIPS) for example) and the thermoplastic elastomer may be a combination of styrene and isoprene, available under brand name KRATON D. Yet another exemplary embodiment includes polyethylene terephthalate (PET) as the thermoplastic and a copolyester elastomer such as HYTREL, or HYTREL®—copolyetherester resin commercially available from E.I.DuPont, as the thermoplastic elastomer.

In FIG. 1A, the needle 110 of the printhead 102 has not yet been inserted into the enclosure 104 through the fluid interconnect 106. When the ink supply is not yet mated with the printhead 102, the fluid interconnect 106 has an unbroken bottom layer 112 which ensures that the fluid 108 cannot leak or escape therefrom. The needle 110 may have an inner channel extending across its length so that when the needle 110 is inserted into the enclosure 104, it is able to access the fluid 108 encased therein. As such, the needle 110 may be considered to be a hollow needle, and is more generally a mating member.

Figure 1B:
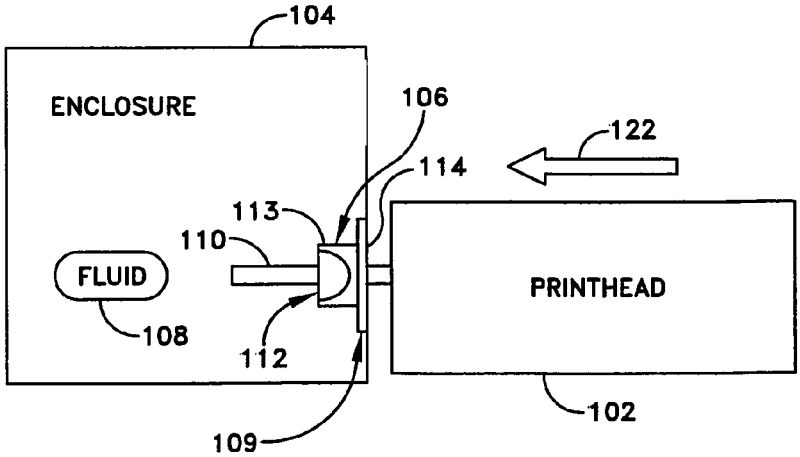

In FIG. 1B, the needle 110 of the printhead 102 is in the process of being inserted into the enclosure 104 through the fluid interconnect 106, as indicated by the arrow 122. Upon application of a predetermined force, the needle 110 pierces through the erstwhile unbroken bottom layer 112 and is now in contact with the fluid 108.

Figure 1C:
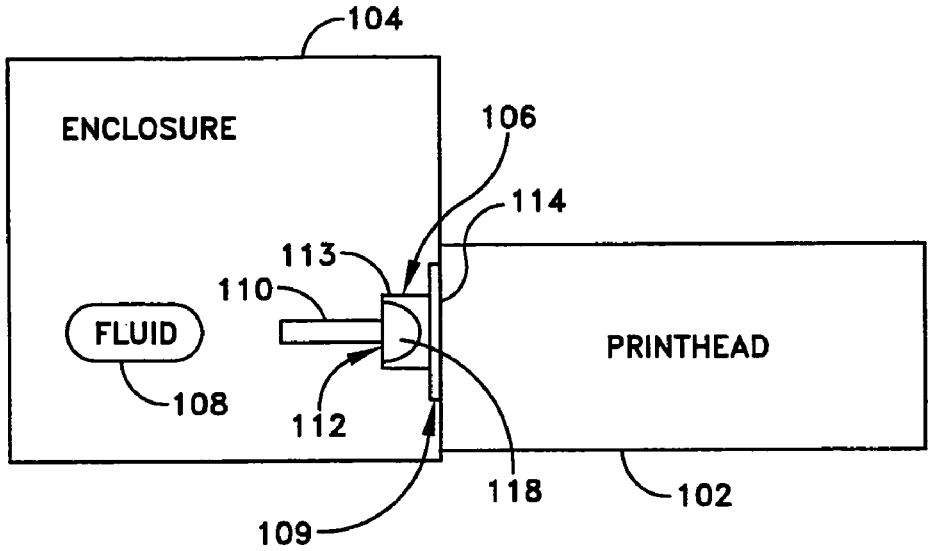

In FIG. 1C, the needle 110 of the printhead 102 has been completely inserted into the enclosure 104 through the fluid interconnect 106. As such, the printhead 102 is now able to access the fluid 108 encased within the enclosure 104, through the needle 110. An annular sealing surface 114 maintains a tight grip over the needle 110. This tight seal prevents leakage or escape of the fluid 108 between the needle 110 and the fluid interconnect 106. A wall 113 extends from the annular sealing surface 114 into the enclosure 104. In an exemplary embodiment, the wall 113 of the fluid interconnect 106 may also maintain a tight grip over the needle 110, via two inclined sections 118, and creates a tight seal between the needle 110 and the fluid interconnect 106.

Figure 1D:
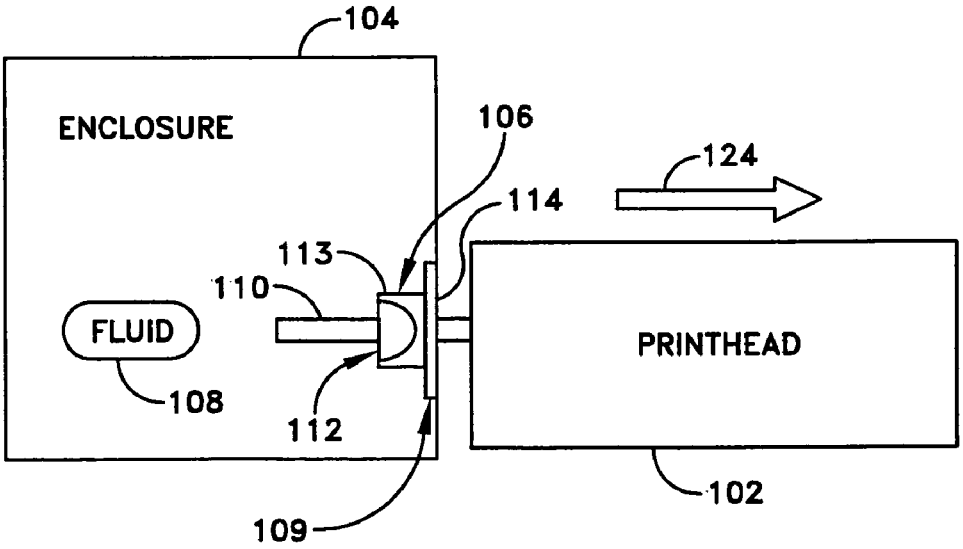

In FIG. 1D, the needle 110 of the printhead 102 is in the process of being removed from the enclosure 104 through the fluid interconnect 106, as indicated by the arrow 124. In an exemplary embodiment, as the needle 110 is removed through the fluid interconnect 106, the two inclined sections 118 of the wall 113 of the fluid interconnect remain in a tight contact with the needle 110. This seal prevents leakage or escape of the fluid along with the needle 110. The fluid 108 on the exterior surface of the needle 110 gets wiped off by the annular sealing surface 114 during removal of the needle and thus remains within the enclosure 104, thereby maintaining a clean exterior surface of the needle 110. Once the needle 110 is completely removed from the enclosure 104, the bottom layer 112 of the bill-shaped portion 113 self seals and thus substantially closes the opening created in the bottom layer 112 by the insertion of the needle 110. This self sealing of the bottom layer 112 substantially closes any path of leakage or escape of the fluid 108 through the fluid interconnect 106, and reduces the likelihood of any fluid leakage.

Figure 2A:
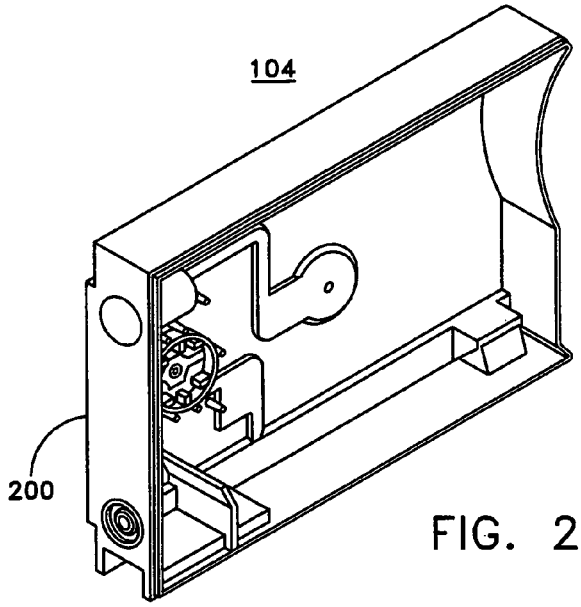
FIGS. 2A, 2B, 2C, and 2D are diagrams of a supply or an enclosure upon which a fluid interconnect is over-molded.
Figure 2B:
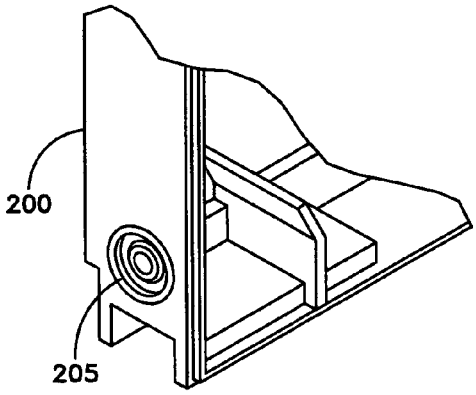
Figure 2C:
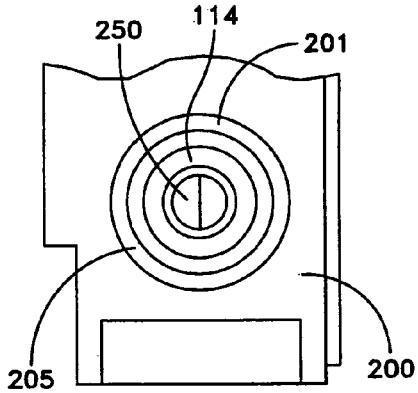
Figure 2D:
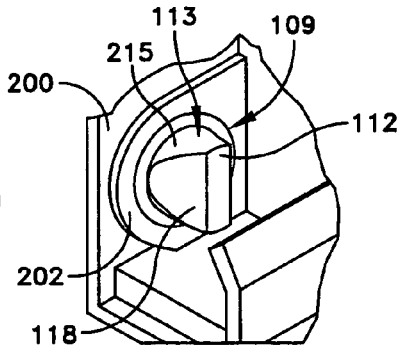

FIGS. 2A-2D show details associated with an enclosure 104, according to an exemplary embodiment of the invention. As before, the enclosure 104 is intended to encase fluid, such as fluid 108 of FIGS. 1A, 1B, 1C, and 1D, and may be an ink supply or may be a part thereof. Referring to FIGS. 2C and 2D, the fluid interconnect 106 is overmolded upon the surface 109 enclosing the opening 111 (of FIG. 1A) in a wall 200 of the enclosure 104. As seen in FIGS. 2A-2D, the circular hole or opening 111 (of FIG. 1A) is defined in the wall 200. The hole or opening 111 can be of other shapes as well, such as rectangular or polygonal.

FIGS. 2C and 2D shows the fluid interconnect 106 overmolded on the surface 109 in the opening 111 in the wall 200 of the enclosure 104. In the illustrated embodiment of the enclosure 104, the wall 200 has the surface 109 on the periphery of the circular hole or opening 111. The fluid interconnect 106 has an upper structure 205 and a lower wall 113. In the illustrated embodiment, the upper structure 205 is doughnut shaped and it corresponds with the shape of the opening 111 in the wall 200. The upper structure 205 fits into the opening 111. If the opening 111 defined in the wall 200 is shaped differently, i.e. not circular, then the upper structure 205 would also be shaped differently to correspond to the shape of the opening 111 in the wall 200. The upper structure 205 is overmolded upon the surface 109 and thus adheres to the surface 109. The material of the fluid interconnect 106 is so selected that it physically entangles at a molecular level with the material of the enclosure 104. This adhesion prevents the leakage or escape of the fluid 104 from the enclosure 104.

Still referring to FIGS. 2C and 2D, the lower wall 113 extends into the enclosure 104. In the illustrated embodiment, the lower wall 113 includes two inclined sections 118. At the end opposite to the opening 111, the two inclined sections 118 are connected to a thin bottom layer 112. The thin bottom layer 112 is adapted such that it can be pierced by the needle 110 or other mating member upon application of a predetermined amount of force. The wall 113 further includes two side sections 215 which are connected to the two inclined sections 118 and the thin bottom layer 112. Initially, when the needle 110 of the printhead has not yet pierced through the thin bottom layer 112, the fluid interconnect 106 acts like a cap to the opening 111 and prevents the leakage or escape of the fluid 108 from the enclosure 104. In an exemplary embodiment of the fluid interconnect, the wall 113 has a thickness of 0.5-0.75 millimeters (mm), whereas the thin bottom layer 112 has a thickness of 0.1-0.3 millimeters (mm). The different sections of the wall 113, such as the two inclined sections 118 and the two side sections 215 may or may not have the same thickness.

Figure 3A:
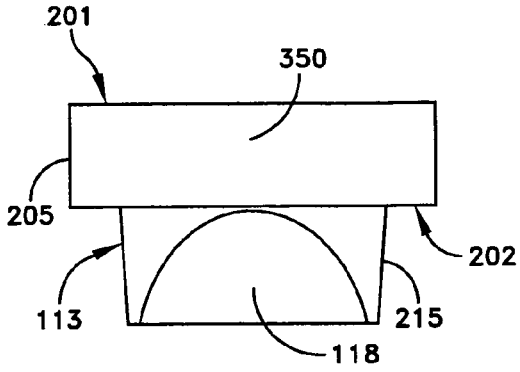
FIGS. 3A, 3B, 3C, 3D, 3E and 3F are diagrams of an overmolded fluid interconnect, according to an exemplary embodiment of the invention.
Figure 3B:
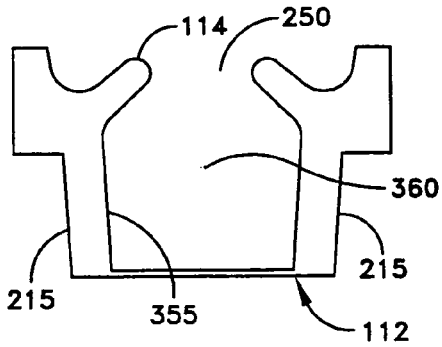
Figure 3C:
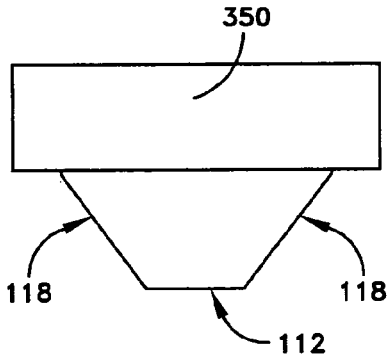
Figure 3D:
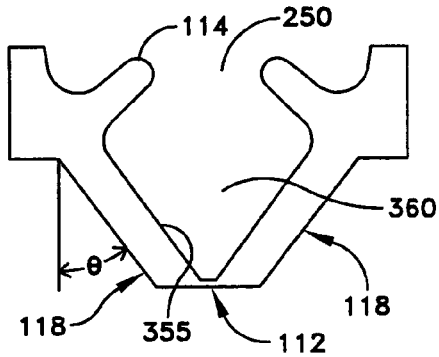
Figure 3E:
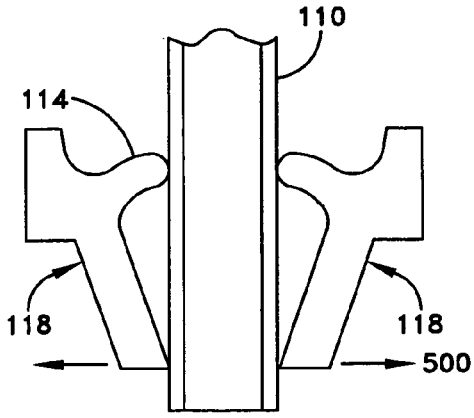
Figure 3F:
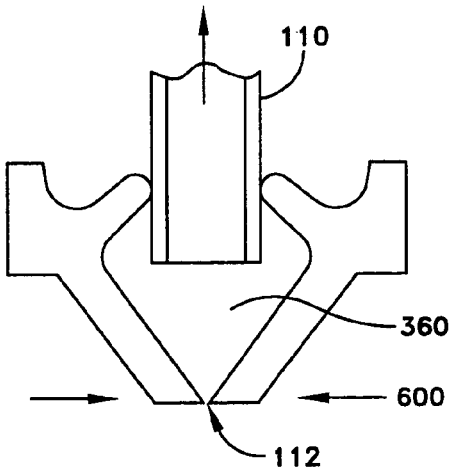

FIGS. 3A, 3B, 3C, 3D, and 3E show one exemplary implementation of the fluid interconnect 106, according to an embodiment of the invention. FIG. 3A shows a front view of the fluid interconnect 106, whereas FIG. 3C shows a side view of the fluid interconnect 106. FIG. 3B shows a cross-sectional front view of the fluid interconnect 106, whereas FIG. 3D shows a cross-sectional side view of the fluid interconnect 106. FIGS. 3A, 3B, 3C, and 3D show the fluid interconnect 106, when the needle 110 has not been inserted into the fluid interconnect 106. FIG. 3E shows the cross-sectional side view of the fluid interconnect 106, when the needle 110 has been inserted into the fluid interconnect 106. FIG. 3F shows the cross-sectional side view of the fluid interconnect 106, when the needle 110 is being pulled out of the fluid interconnect 106. In one embodiment, the inclined sections 118 define an angle θ with the vertical. In an exemplary embodiment the inclined sections 118 define an angle of approximately 38 degrees with the vertical. In an exemplary embodiment, the entire fluid interconnect 106, including the upper structure 205 and the wall 113, is overmolded into an opening 111 in the wall 200 of the enclosure 104 as a unitary (monolithic) structure. Until a mating member, such as a needle 110, pierces the relatively thin bottom layer 112 there is no path for the fluid 108 to leak or escape from through the fluid interconnect 106. Overmolding the fluid interconnect 106 in the enclosure 104 also reduces manufacturing and assembly processes wherein such a part would be made separately and then installed in an enclosure in a separate process.

The wall 113 encloses a pathway 360 for a mating member, such as the needle 1110. The interior surface 355 of the wall 113 defines the pathway 360. At one end, the pathway 360 communicates with the opening 250 and at the other end, the pathway is closed by the thin bottom layer 112. The pathway can have different shapes, such as cylindrical or conical or domed, so long as it allows the mating member such as the needle 110 to pass through.

The annular sealing surface 114 seals around the needle 110 due to a slight interference fit, and also cleans the exterior surface of the needle 110, when the needle is being removed from the enclosure 104. As shown in FIG. 3E, when the needle 110 is inserted into the enclosure 104 through the fluid interconnect 106, the inclined sections 118 are pushed radially outward from the needle 110 in the direction of the arrows 500. At the same time, the annular sealing surface 114 may be pushed radially inward toward the needle 110 because of the hinging action of the inclined sections 118 on the annular sealing surface 114.

Once the needle has been inserted into the fluid interconnect 106, it may be removed by being pulled from the fluid interconnect 106. Referring now to FIG. 3F, when the needle 110 is pulled out from the fluid interconnect 106 the inclined sections 118 pull themselves together due to the absence of the needle pushing them apart, as shown by the arrows 600. This sealing prevents the fluid 108 from leaking or escaping from the enclosure 104 while the needle 110 is being pulled out from the enclosure 104. At this instant also, the annular sealing surface tightly grips the needle 110, thereby preventing any leakage or escape of the fluid 108 from the enclosure 104, while the needle 110 is being pulled out. Because of the self-sealing nature of the thermoplastic elastomer material 350 used for the fluid interconnect 106, the pierced opening created by the needle 110 in the thin bottom layer 112 is substantially sealed. Thus, when the needle 110 has been completely pulled out from the enclosure 104, the self-sealing thin bottom layer 112 of the fluid interconnect 106 reduces the likelihood of any leakage or escape of the fluid 108 from the enclosure 104.

It is noted that, although specific embodiments have been illustrated and described herein, it will be appreciated by those of ordinary skill in the art that any arrangement calculated to achieve the same purpose may be substituted for the specific embodiments shown. For example, whereas some embodiments of the invention have been described in relation to a fluidic interconnect for an ink supply that then mates with an inkjet printhead or an inkjet printhead component, other embodiments of the invention can be employed in relation to applications other than inkjet-printing devices. This application is thus intended to cover any adaptations or variations of the disclosed embodiments of the present invention. Therefore, it is manifestly intended that this invention be limited only by the claims and equivalents thereof.

We claim:

1. A fluid interconnect for a fluid enclosure, said fluid interconnect comprising:

an overmolded sealing surface of a thermoplastic elastomeric material, said sealing surface having an opening, said sealing surface overmolded upon a thermoplastic surface of a fluid enclosure;

a wall of said elastomeric material connected to said overmolded sealing surface, said wall enclosing a pathway, said pathway communicating between said opening and a first end;

first and second inclined sections extending from said wall and biased toward one another;

an annular sealing surface extending radially inward from said wall toward said first end, wherein said first and second inclined sections have a hinging relationship with said annular sealing surface; and a breakable closing layer connected to said wall and to said first and second inclined sections, said layer closing said pathway at a second end of said pathway.

2. The fluid interconnect of claim 1, wherein said pathway is conical.

3. The fluid interconnect of claim 1, wherein said pathway is cylindrical.

4. The fluid interconnect of claim 1, wherein said pathway is domed.

5. The fluid interconnect of claim 1, wherein said opening in said overmolded sealing surface is generally circular.

6. The fluid interconnect of claim 1, further comprising a mating member insertable in said opening and through said pathway to pierce said layer for extracting a fluid from said fluid enclosure, and wherein said first and second inclined sections seal with said mating member when it is inserted between said first and second inclined sections and said annular sealing surface cleans said mating member when it is withdrawn therefrom.

7. The fluid interconnect of claim 6, wherein said mating member comprises a hollow needle.

8. The fluid interconnect of claim 7, wherein said needle comprises an injection molded thermoplastic needle or a metallic needle.

9. A supply comprising:

an enclosure having one or more openings;

fluid encased within said enclosure;

an overmolded sealing surface of a thermoplastic elastomeric material, said sealing surface overmolded in one of said one or more openings;

a wall of said elastomeric material connected to said overmolded sealing surface, said wall enclosing a pathway, said pathway communicating between said opening and a first end;

first and second inclined sections extending from said wall and biased toward one another;

an annular sealing surface extending radially inward from said wall toward said first end, wherein said first and second inclined sections have a hinging relationship with said annular sealing surface; and a breakable closing layer connected to said wall and to said first and second inclined sections, said layer closing said pathway at a second end of said pathway.

10. The supply of claim 9, wherein said wall has an interior surface defining said pathway, wherein said pathway is adapted to receive a mating member, and wherein said first and second inclined sections seal with said mating member when it is inserted between said first and second inclined sections and said annular sealing surface cleans said mating member when it is withdrawn therefrom.

11. The supply of claim 9, wherein said layer is capable of being pierced by a mating member, thereby creating a pierced opening in said layer.

12. The supply of claim 11, wherein, upon extraction of said mating member, said layer substantially closes said pierced opening created by said mating member.

13. The supply of claim 9, wherein said fluid is a printing ink.

14. A system comprising:

one or more enclosures of thermoplastic material, each having one or more openings and encasing fluid;

one or more fluid interconnect comprising:

an overmolded sealing surface of a thermoplastic elastomeric material, said sealing surface overmolded in one of said one or more openings;

a wall of said elastomeric material connected to said overmolded sealing surface, said wall enclosing a pathway, said pathway communicating between said opening and a first end;

first and second inclined sections extending from said wall and biased toward one another;

an annular sealing surface extending radially inward from said wall toward said first end, wherein said first and second inclined sections have a hinging relationship with said annular sealing surface; and a breakable closing layer connected to said wall and to said first and second inclined sections, said layer closing said pathway at a second end of said pathway; and one or more mating members corresponding to said fluid interconnect, each mating member insertable into one of the enclosures through a corresponding fluid interconnect, wherein said mating member is capable of piercing through said layer, and creating an opening in said layer.

15. The system of claim 14, wherein said layer is capable of substantially closing the said opening created by said mating member, upon extraction of said mating member from said layer.

16. The system of claim 14, wherein said pathway enclosed by said wall is adapted to receive said mating member.

17. The system of claim 16, wherein said pathway is cylindrical, conical or domed.

18. The system of claim 14, wherein said inclined sections seal with at least one of said mating members when said mating member is inserted into one of said enclosures.

19. The system of claim 14, wherein said annular sealing surface cleans said mating member when it is withdrawn from one of said enclosures.

* * * * *